United States Patent [19]

Lopez-Crevillen

[11] Patent Number: 4,719,892

[45] Date of Patent: Jan. 19, 1988

[54] CAVITY CLOSURE WITH ISOLATOR SEAL AND METHOD

[75] Inventor: Jose M. Lopez-Crevillen, Westland, Mich.

[73] Assignee: General Motors Corporation, Detroit, Mich.

[21] Appl. No.: 878,725

[22] Filed: Jun. 26, 1986

[51] Int. Cl.[4] ..... F02B 77/11

[52] U.S. Cl. ..... 123/198 E; 29/416; 123/195 C; 188/379; 220/222; 220/378; 267/136; 267/140.4; 267/141.4

[58] Field of Search ..... 188/379; 267/136, 140.4, 267/141.4, 141.5, 141.6; 29/416; 220/221, 222, 378; 123/195 C, 198 E, 192 R

[56] References Cited

U.S. PATENT DOCUMENTS

| | | | |
|---|---|---|---|
| 2,323,216 | 6/1943 | Goldschmidt | 29/416 |
| 2,426,800 | 9/1947 | Triplett | 220/378 X |
| 2,706,577 | 4/1955 | Wolf | 220/378 |
| 2,873,411 | 2/1959 | Donaldson et al. | 220/378 X |
| 3,726,365 | 4/1973 | Russell | 123/198 E |
| 3,773,142 | 11/1973 | Bragg et al. | 123/198 E X |
| 4,244,438 | 1/1981 | Willmann | 123/198 E |
| 4,434,977 | 3/1984 | Chiba et al. | 267/33 |
| 4,509,475 | 4/1985 | Visek | 123/198 E X |
| 4,527,710 | 7/1985 | Crevillen | 220/378 |

FOREIGN PATENT DOCUMENTS

| | | | |
|---|---|---|---|
| 1950286 | 4/1971 | Fed. Rep. of Germany | 220/378 |
| 771860 | 8/1934 | France | 220/378 |

*Primary Examiner*—George E. A. Halvosa
*Attorney, Agent, or Firm*—Robert J. Outland

[57] ABSTRACT

A cavity closure, such as an engine accessory or inspection cover, is provided having separate rim and central panel members secured together by a vibration absorbent elastomer which acts both to seal a gap between the memebrs and the outer periphery of the closed opening against leakage and to minimize noise generation by the central panel by damping panel vibrations and isolating the panel against the transmission of vibrations to it from the supporting rim and engine housing. A preferred manufacturing method involves forming the rim and central panel as a unit and then separating them by shearing to form opposed edges of identical configuration which are longitudinally displaced prior to applying the bead joining the members and providing sealing and vibration isolation.

8 Claims, 5 Drawing Figures

CAVITY CLOSURE WITH ISOLATOR SEAL AND METHOD

FIELD

This invention relates to low noise vibration isolated engine and housing covers and similar closures for sealing openings in housings subject to noise inducing vibration.

BACKGROUND

It is known in the art to provide internal combustion engines and other machinery with covers, closure panels and the like which are mounted upon or provided with resilient means for supporting and sealing all or a portion of such covers. However, there remains a need for low cost vibration damped covers for sealing openings in engine housings and the like.

INVENTION SUMMARY

The present invention provides an engine housing cover and method involving a vibration damped sheet metal and elastomer cover which is easily manufactured and installed in place of conventional cast or fabricated covers to provide a reduction in noise generation together with simplification of handling and installation procedures.

The invention involves a novel cover made as an assembly having rim and central panel members connected by a vibration absorbent elastomer. Preferably the elastomer includes a compressible rim or lip portion adapted to sealingly engage the sealed opening so as to provide a one piece cover and seal assembly. Also, the rim and panel members are preferably sheared from a common blank after forming for economy of material and processing.

These and other features and advantages of the invention will be more fully understood from the following description of selected embodiments taken together with the accompanying drawing.

DRAWINGS

DESCRIPTION

Figure 1:
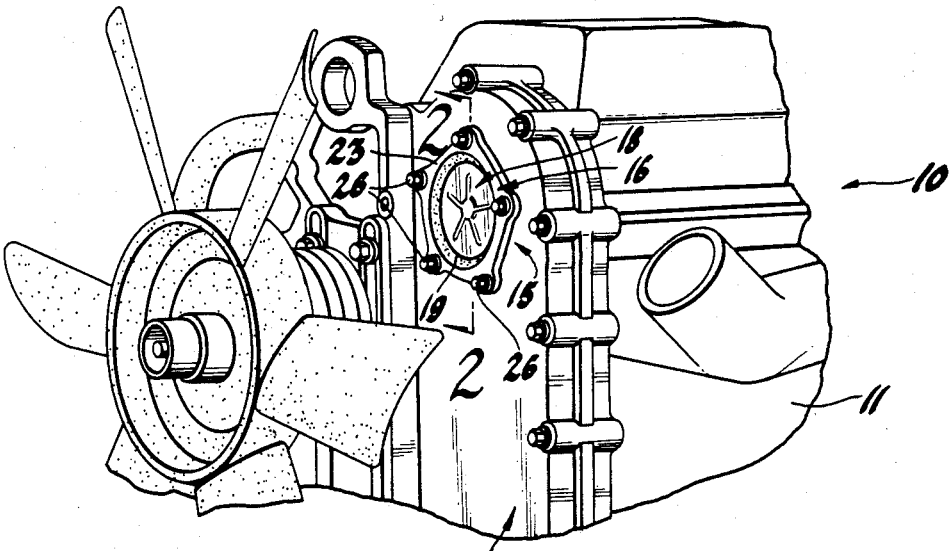
FIG. 1 is a fragmentary pictorial view of an internal combustion engine having an accessory housing cover formed according to the invention.

In FIGS. 1–4 of the drawings, numeral 10 generally indicates an internal combustion engine having a cylinder block and head assembly 11 at one end at which there is conventionally mounted a camshaft and accessory drive housing 12 having an opening 14. The opening 14 communicates an internal cavity containing gear or chain drive means or the like, not shown, with the exterior of the engine for the purpose of inspection or for the optional mounting of an engine driven accessory connectable with and driven by the drive means located within the housing. Similar openings 14 may be provided at other locations on the engine accessory housing, the block or other cavity defining housing portions of the engine.

To close the opening 14 when it is not being used for inspection or the mounting of an accessory, the engine is provided with a cover 15 formed in accordance with the invention. The cover comprises an assembly of three elements, a rigid outer rim 16, a rigid central panel 18 and a bead 19 of resilient vibration absorbent elastomer connecting the rim with the panel. The rim 16 and panel 18 may be formed of carbon steel or other suitable metal or rigid formable plastic material available in sheet form.

Preferably the rim and central panel are initially formed integral from a single sheet of material and are subsequently separated by shearing to define identically configured inner and outer edges 20, 22 of the rim and panel respectively. The resulting outer rim preferably includes a peripheral portion or flange 23 having a number of spaced openings 24 in which are received fasteners such as bolts 26. These threadably engage threaded bores 27 in the housing 12 for securing the cover to the housing.

Inwardly of the flange 23, the rim has an inwardly extending support portion 28. The latter includes a lip 30 extending generally longitudinally of the direction of the opening 14 to a point within the opening 14 where it turns downwardly, terminating in an inner edge 20.

The rigid central panel 18 may be generally flat as shown or of any desired shape. It includes a peripheral outer portion 31 extending inward from the edge 22 and preferably has a raised central embossment 32 to further stiffen the structure.

In assembly of the cover elements, the outer edge 22 of the central panel 18 is longitudinally displaced from the inner edge 20 of the lip 30. The displacement is of an amount approximately half the length of the lip to a point intermediate the planes of the rim inner edge 20 and the flange 23.

The cover is completed by molding, or otherwise applying, the bead 19 of elastomer onto the lip 30 of the rim and the outer portion 31 of the central panel 18, thereby filling the gap between the longitudinally offset edges 20, 22 of the rim and panel and holding these members together in assembly. The bead as formed preferably also includes a compressible outer edge 34 lying outwardly of the lip 30 and engaging, when mounted on the housing 12, the interior surface of the opening 14.

Figure 2:
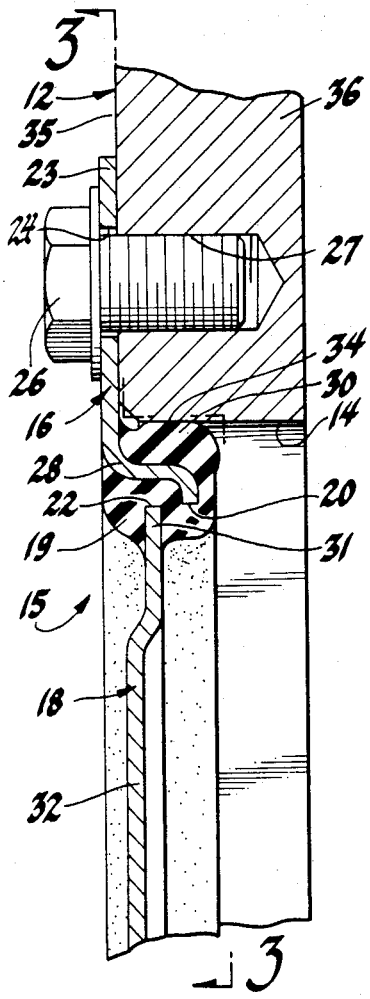
FIG. 2 is an enlarged fragmentary cross-sectional view from the plane indicated by the line 2—2 of FIG. 1.
Figure 3:
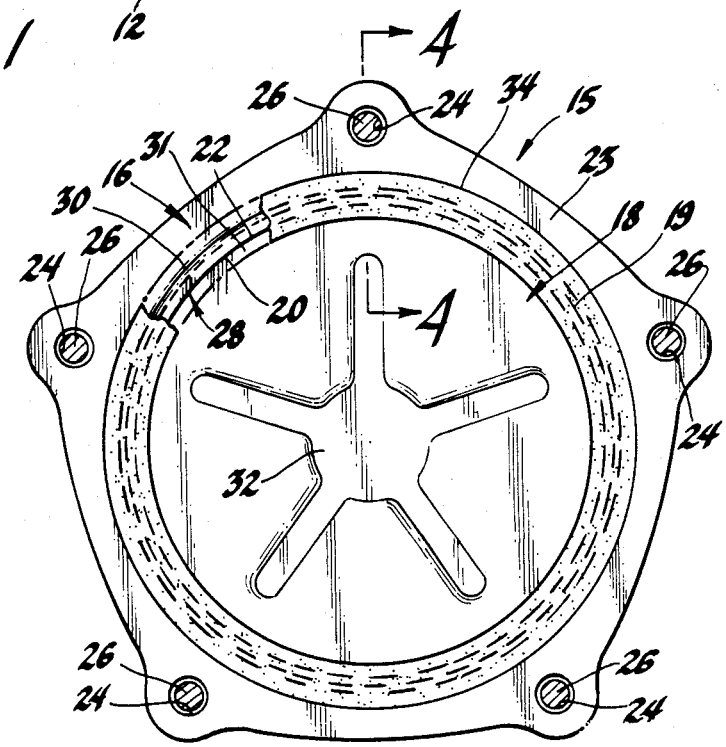
FIG. 3 is a cross-sectional view from the line 3—3 of FIG. 2 showing the rear of the cover with part of the elastomer broken away to show the underlying metal portions.
Figure 4:
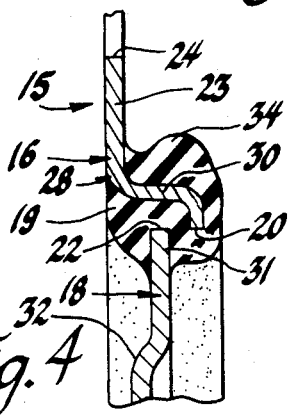
FIG. 4 is an enlarged cross-sectional view of the cover prior to installation in the associated housing as seen from the plane of the line 4—4 of FIG. 3.

Thus, as applied in FIGS. 1–3, the planar flange 23 of the rim engages the outer surface 35 of the wall 36 of the housing 12 in locations around the opening 14. The resilient bead 19, carried largely on the lip 30, extends within the opening with the compressible edge 34 engaging the inner surface 14 which defines the opening.

The bead 19 seals the opening against leakage past the rim member 16 either outward of the lip 30 or between the lip 30 and the central panel 18. Additionally, the vibration absorbing qualities of the elastomer selected for the resilient bead damp vibrations in the central panel and isolate the panel from vibrations generated in the engine housing and carried to the rim 16. In this way, noise generation due to vibration or drumming of the central panel is minimized and a one piece cover assembly is provided which may be installed without the necessity of storing and inserting a separate seal or gasket member during installation.

In choosing a suitable elastomer for application in a particular environment, various qualities must be considered; including the vibration absorbing or damping capability, oil and temperature resistance, where needed, and moldability, as well as the mass of the central panel and the adjacent supporting structure on which the bead is supported. Various rubber like materials may be usable; however, elastomer materials with high damping characteristics such as ethylene acrylic are preferred at present. Silicone rubber may also be appropriately applied where its properties of high heat resistance and low compression set are required.

Figure 5:
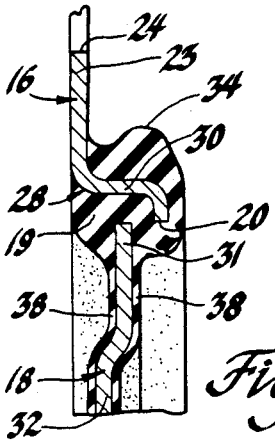
FIG. 5 is a cross-sectional view similar to FIG. 4 but illustrating an alternative embodiment of cover according to the invention.

It should be obvious that alternative arrangements incorporating the basic concepts of the present invention can easily be devised. For example the outer rim member could be configured so that the associated bead applied thereto would engage the outer surface 35 of the wall 36 to seal the periphery instead of engaging the surface of the opening 14. Another alternative is illustrated in FIG. 5 where a flash coating 38 of the elastomer material, which may be of any suitable thickness, for example 1/16 to ⅛ inch, is provided on both sides of the central panel 18 to further damp its resonant qualities and minimize noise generation.

The manufacture of a cover in accordance with the invention may be accomplished in any suitable manner, but is preferably carried out by the following manufacturing steps.

1. A sheet of suitable material, such as low carbon steel, is selected from which a unitary rim and panel blank is formed by stamping.

2. The blank is cut from the formed sheet by shearing the outer edges of the rim and, at the same time, the rim and panel members are separated by shearing their abutting edges, thereby forming the oppositely directed identically configured inner and outer edges 20, 22 respectively.

3. The rim and panel members are then placed in a mold with the panel edge 22 longitudinally displaced a desired amount longitudinally from the rim edge 20 and the bead 19 of elastomer is molded in place on the inwardly extending lip portion of the rim and the outer portion 31 of the panel, sealing the gap and forming the raised compressible edge 34 of the final configuration.

4. Optionally the molding step can include the flash coating of one or both sides of the central panel as illustrated in FIG. 5.

While the invention has been described by reference to certain embodiments and methods chosen for purposes of illustration, it should be understood that numerous changes could be made without departing from the spirit and scope of the inventive concepts disclosed. Accordingly, it is intended that the invention not be limited to the disclosed embodiments and methods, but that it be given the full scope permitted by the language of the following claims.

The embodiments of the invention in which an exclusive property or privelege is claimed are defined as follows:

1. A vibration resistant cover for closing an opening extending longitudinally through a cavity defining wall of a housing subject to noise including vibration, said wall having an outer face and an inwardly facing peripheral surface about the opening adjacent said face, said cover comprising a rigid outer rim having a flange operatively engageable with the wall outer face and adapted to be secured thereto, said rim also having an inwardly extending support portion including a lip extending longitudinally from adjacent the flange to an inturned portion with a continuous inner edge, a rigid central panel extending laterally within the rim support portion and having an outer portion with a continuous outer edge parallel with, of similar configuration to and longitudinally offset from the inner edge of the rim support portion, and a bead of resilient vibration absorbent elastomer secured to said rim support portion and to said panel outer portion and sealing a peripheral gap between said offset inner and outer edges, said bead including a compressible edge extending laterally outward from the longitudinal lip and which upon installation sealingly engages the peripheral surface of said wall around the opening to thereby seal against leakage between the cover and the opening, said bead further acting to seal and to provide resilient damping between the central panel and the outer rim so as to close the opening and limit the transmission of housing vibrations to the central panel, thereby minimizing the generation of noise by the panel.

2. A cover as in claim 1 wherein at least a major portion of one side of said central panel is covered by a layer of said elastomer to further damp vibration of said panel.

3. A cover as in claim 2 wherein both sides of the central panel are covered by said elastomer.

4. A cover as in claim 1 wherein the outer edge of the central panel outer portion is longitudinally offset from the inner edge of the rim support portion in the direction opposite the longitudinal extension of the lip but less than the length of such extension so that the panel outer edge lies longitudinally between the extreme ends of the lip longitudinal extension.

5. A cover as in claim 1 wherein at least one side of said central panel is covered by a layer of said elastomer to further damp vibration of said panel.

6. A vibration resistant cover for closing an opening extending longitudinally through a cavity defining wall of a housing subject to noise inducing vibration, said wall having an outer face and an inwardly facing peripheral surface about the opening adjacent said face, said cover comprising a rigid outer rim formed of a sheet material and having a flange operatively engageable with the wall outer face and adapted to be secured thereto, said rim also having an inwardly extending support portion including a lip extending longitudinally from adjacent the flange to an inturned portion with a continuous inner edge, a rigid central panel formed of sheet material extending laterally within the rim support portion and having an outer portion with a continuous outer edger parallel with, of identical configuration to and longitudinally offset from the inner edge of the rim support portion, said outer rim and central panel being initially formed together from a single sheet of material and being subsequently separated by shearing to form said indentically configured inner and outer edges, and a bead of resilient vibration absorbent elastomer secured to said rim support portion and to said panel outer portion and sealing a peripheral gap between said offset inner and outer edges, said bead including a compressible edge extending laterally outward from the longitudinal lip and which upon installation sealingly engages the peripheral surface of said wall around the opening to thereby seal against leakage between the cover and the opening, said bead further acting to seal and to provide resilient damping between the central panel and the outer rim so as to close the opening and limit the transmission of housing vibrations to the central panel, thereby minimizing the generation of noise by the panel.

7. In combination, a vibration resistant cover closing an opening through a cavity defining wall of an engine housing subject to noise inducing vibration, said wall having an outer face and an inwardly facing peripheral surface about the opening adjacent said face, wherein said cover comprises a rigid outer rim having a flange operatively engaging and secured to the wall outer face, said rim also having an inwardly extending support portion including a lip extending longitudinally from adjacent the flange to an inturned portion with a continuous inner edge, a rigid central panel extending laterally within the rim support portion and having an outer portion with a continuous outer edge parallel with, of similar configuration to and longitudinally offset from the inner edge of the rim support portion, and a bead of resilient vibration absorbent elastomer secured to said rim support portion and to said panel outer portion and sealing a peripheral gap between said offset inner and outer edges, said bead including a compresssible edge extending laterally outward from the longitudinal lip and which sealingly engages said wall around the opening to thereby seal against leakage between the cover and the opening, said bead further acting to seal and to provide resilient damping between the central panel and the outer rim so as to close the opening and limit the the transmission of housing vibrations to the central panel, thereby minimizing the generation of noise by the panel.

8. A combination according to claim 7 wherein the outer edge of the central panel portion is longitudinally offset from the inner edge of the rim support portion in the direction opposite the longitudinal extension of the lip but less than the length of such extension so that the panel outer edge lies longitudinally between extreme ends of the longitudinal extension of the lip.

* * * * *